US005755462A

United States Patent [19]

Lupi

[11] Patent Number: 5,755,462

[45] Date of Patent: May 26, 1998

[54] MEDICATION SAMPLE AND MEDICATION PRESCRIPTION DEVICE

[76] Inventor: Louis A. Lupi, 677 N. Washington Blvd., Sarasota, Fla. 34236

[21] Appl. No.: 614,128

[22] Filed: Mar. 12, 1996

[51] Int. Cl.[6] ..... B42D 15/00

[52] U.S. Cl. ..... 283/56; 283/900; 206/534

[58] Field of Search ..... 283/56, 117, 900, 283/72; 206/528, 529, 534.1, 534.2, 538, 534

[56] References Cited

U.S. PATENT DOCUMENTS

| | | | |
|---|---|---|---|
| 364,623 | 6/1887 | Beidler | 206/538 |
| 1,492,101 | 4/1924 | Mordecai | 206/538 |
| 3,111,220 | 11/1963 | Bostrom | 206/534 |
| 3,327,843 | 6/1967 | O'Mera et al. | 206/534.1 |
| 3,381,808 | 5/1968 | McGraw | 206/534 |

FOREIGN PATENT DOCUMENTS

| | | | |
|---|---|---|---|
| 2064959 | 10/1993 | Canada | 206/528 |
| 3832050 | 3/1990 | Germany | 206/538 |

*Primary Examiner*—Willmon Fridie, Jr.
*Attorney, Agent, or Firm*—Charles J. Prescott

[57] ABSTRACT

A combination medication sample, in a reusable container and medication prescription device includes a flat support panel having an obverse or front facing surface which defines a first and second portion thereof. A removable, reusable medication container holding a small sample quantity of medication in pill, tablet or capsule form is viewably attached to the first portion and a removable medication prescription form is attached to the second portion of the front surface of the support panel. This combination permits the physician to simultaneously distribute a starter quantity of medication and to write a prescription for a larger quantity of medication. A cover panel for protecting the prescription form, a pocket for holding printed material relating to the medication, and ample space for printed promotional indicia on behalf of the prescription manufacturer are also provided.

3 Claims, 3 Drawing Sheets

MEDICATION SAMPLE AND MEDICATION PRESCRIPTION DEVICE

BACKGROUND OF THE INVENTION

1. Scope of Invention

This invention relates generally to packaging for medication samples, and more particularly to a combination sample medication packaging and medication prescription form for prescribing an additional quantity of the medication.

2. Prior Art

Pharmaceutical manufacturers routinely distribute packaged samples of small quantities of medication for distribution by medical practitioners who are likely to prescribe the medication to their patients. These medications are typically in the form of capsules, tablets, or pills or may also be in the form of bottled liquid medications. Moreover, many times when the medical practitioner distributes samples of the medication, a medication prescription form will also be completed so that the patient may obtain a larger quantity of the prescribed medication for continued use after using the sample supply. In most cases, the sample medication packaging or enclosure is also destroyed or otherwise rendered unusable after gaining access to the first quantity of medication to be consumed. This also destroys any printed advertising indicia which accompanies the medication sample.

Additionally, unless additional exterior packaging is provided with the sample medication at considerable more costs, no further opportunity is provided for including separate advertising and promotion of the medication by the pharmaceutical company or medication description material.

The present invention provides a combination medication sample within reusable medication enclosure prescription form which may be distributed by the medical practitioner while simultaneously providing a convenient opportunity to write a prescription for quantities of the medication prescribed. The pharmaceutical manufacturer is not only provided significant additional opportunity for presenting printed indicia of the medication product, but also provided with a conveniently located medication clinical description brochure and other promotional materials storage pocket in one convenient, easily storable and carryable arrangement.

BRIEF SUMMARY OF THE INVENTION

This invention is directed to a combination medication sample, in a reusable container and medication prescription device including a flat support panel having an obverse or front facing surface which defines a first and second portion thereof. A removable, reusable medication container holding a small sample quantity of medication in pill, tablet or capsule form is viewably attached to the first portion and a removable medication prescription form is attached to the second portion of the front surface of the support panel. This combination permits the physician to simultaneously distribute a starter quantity of medication and to write a prescription for a larger quantity of medication. A cover panel for protecting the prescription form, a pocket for holding printed material relating to the medication, and ample space for printed promotional indicia on behalf of the prescription manufacturer are also provided.

It is therefore an object of this invention to provide a combination enclosure with medical sample and medication prescription device for use by authorized medical practitioners in distributing start-up samples of medication to patients while also conveniently providing a prescription form which, when properly filled in by the medical practitioner, allows the patient to purchase a larger prescribed supply of the medication.

It is another object of this invention to provide a combination medical sample and medication prescription device which is conveniently usable by medical practitioners and also provides ample means for presenting printed advertising and promotional indicia by the pharmaceutical manufacturer.

It is yet another object of this invention to provide a combination medical sample and prescription form device which includes a reusable medication sample enclosure which is disposable after the medication contained therein is consumed.

In accordance with these and other objects which will become apparent hereinafter, the instant invention will now be described with reference to the accompanying drawings.

DETAILED DESCRIPTION OF THE INVENTION

Figure 1:
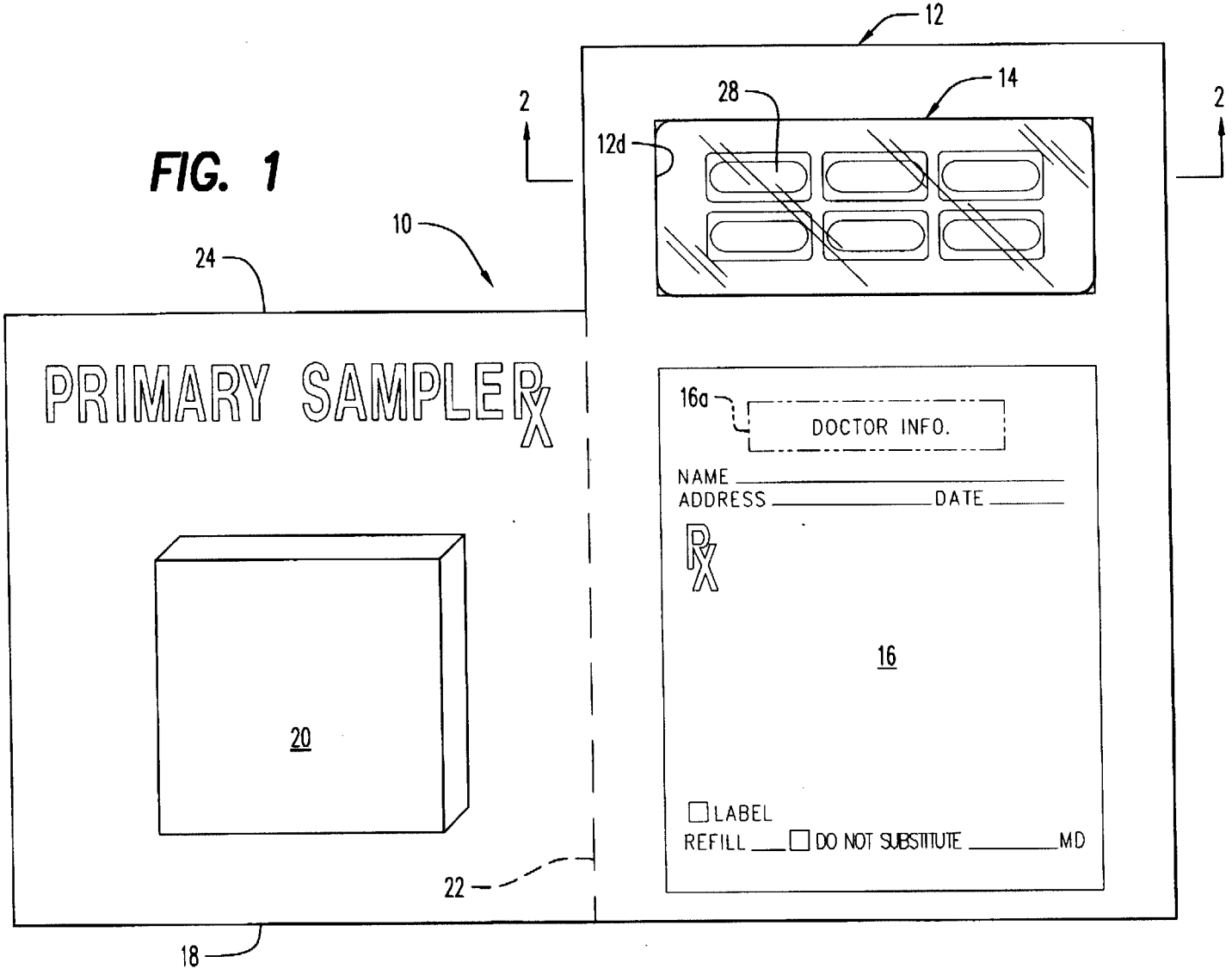
FIG. 1 is a front plan view of the preferred embodiment of the invention in open configuration.

Referring now to the drawings, the preferred embodiment of the invention is shown generally at numeral 10 and includes a rectangular flat support panel 12 formed of two layers of relatively stiff paper material which supports a medication sample enclosure shown generally at numeral 14 and a removable medication prescription form 16, both attached to the front or obverse surface of the support panel 12.

Figure 2:
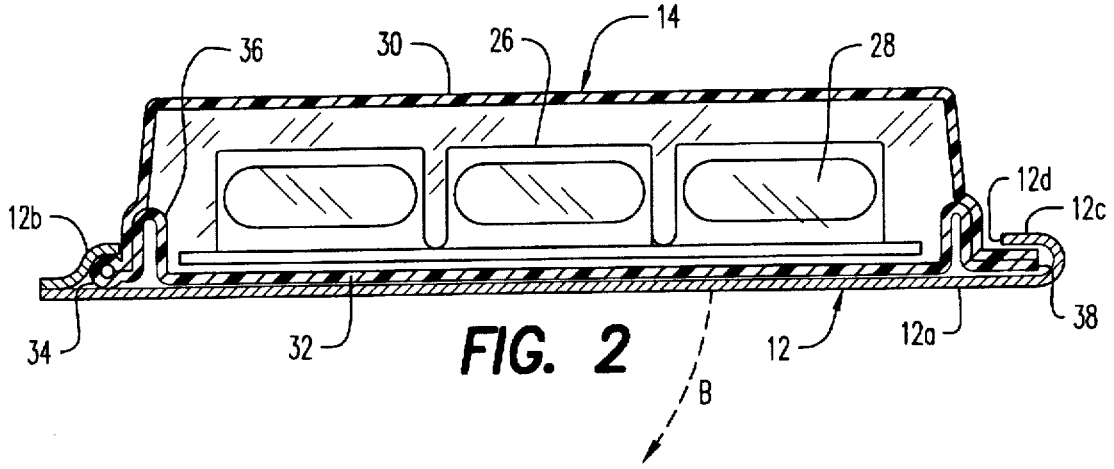
FIG. 2 is a section view in the direction of arrows 2—2 in FIG. 1.

As best seen in FIG. 2, the medication enclosure 14 includes a single-piece thin, transparent, plastic molded container having a top or lid portion 30 hingedly connected at 34 to a bottom or base portion 32. The base 32 includes a continuous formed upstanding flange or rib 36 which lockably engages into the margins of the upper portion 30 as shown in FIG. 2. Tab 38 of the base 32 is provided to open the container about hinge 34 in the direction of arrow B for access to the packaged medication 26 which holds a sample quantity of pills, capsules or tablets 28.

The medication enclosure 14 is held in place between the inner surface of the back layer **12*a* of support panel 12 and front portions 12*a* and 12*b* of support panel 12. Lid 30 viewably extends from aperture 12*a* formed through the front layer of support panel 12**.

The medication prescription form 16 is removably attached by releasible adhesive against the front surface of the lower portion of the support panel 12 and contains preprinted physician's information at **16*a* for enhanced prestige and identification afforded to the prescribing medical practitioner. Having the preprinted prescription order form 16** readily accessible to the medical practitioner, it is of utmost convenience to provide the patient with sample medication for start-up purposes and also to simultaneously write a prescription for an ongoing supply of medication without otherwise searching for an office medication prescription form.

Figure 3:
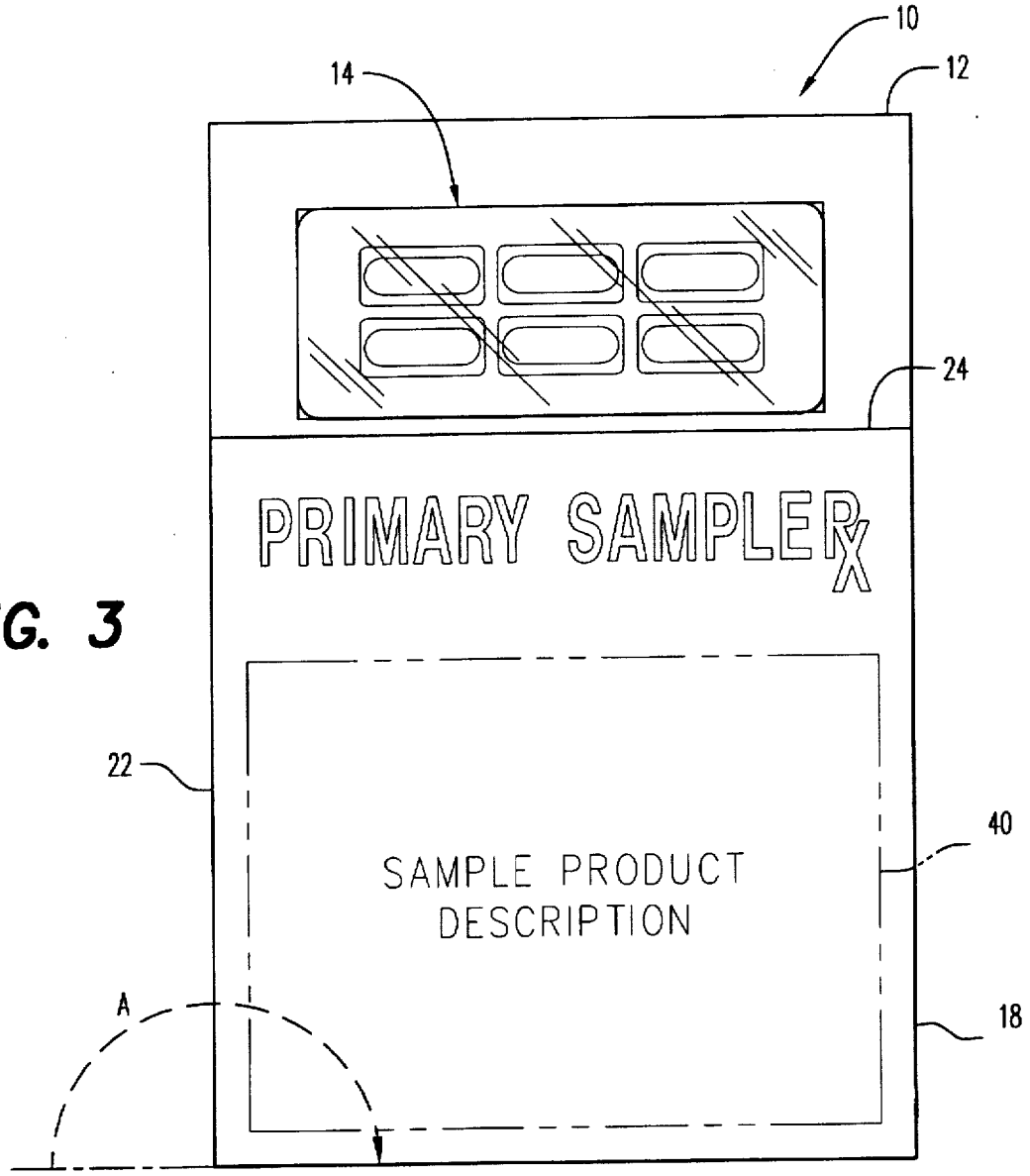
FIG. 3 is a view similar to FIG. 2 with the invention in a closed configuration.

A flat cover panel 18, which is pivotally connected to the support panel 12 along a common fold line 22 therebetween, provides two additional important functions. When in a closed position as shown in FIG. 3, the cover panel 18 both lays protectively against the medication prescription form 16 and also provides a distinctive advertising surface for printed indicia at 40. When opened in the reverse direction from arrow A in FIG. 3, the inner surface of the cover panel 18 provides for the printed placement of additional promotional indicia at 20 describing the brand name, features and benefits of the sample medication 28. The cover panel 18 is integrally formed with relatively stiff paper stock material in common with the support panel 12.

Figure 4:
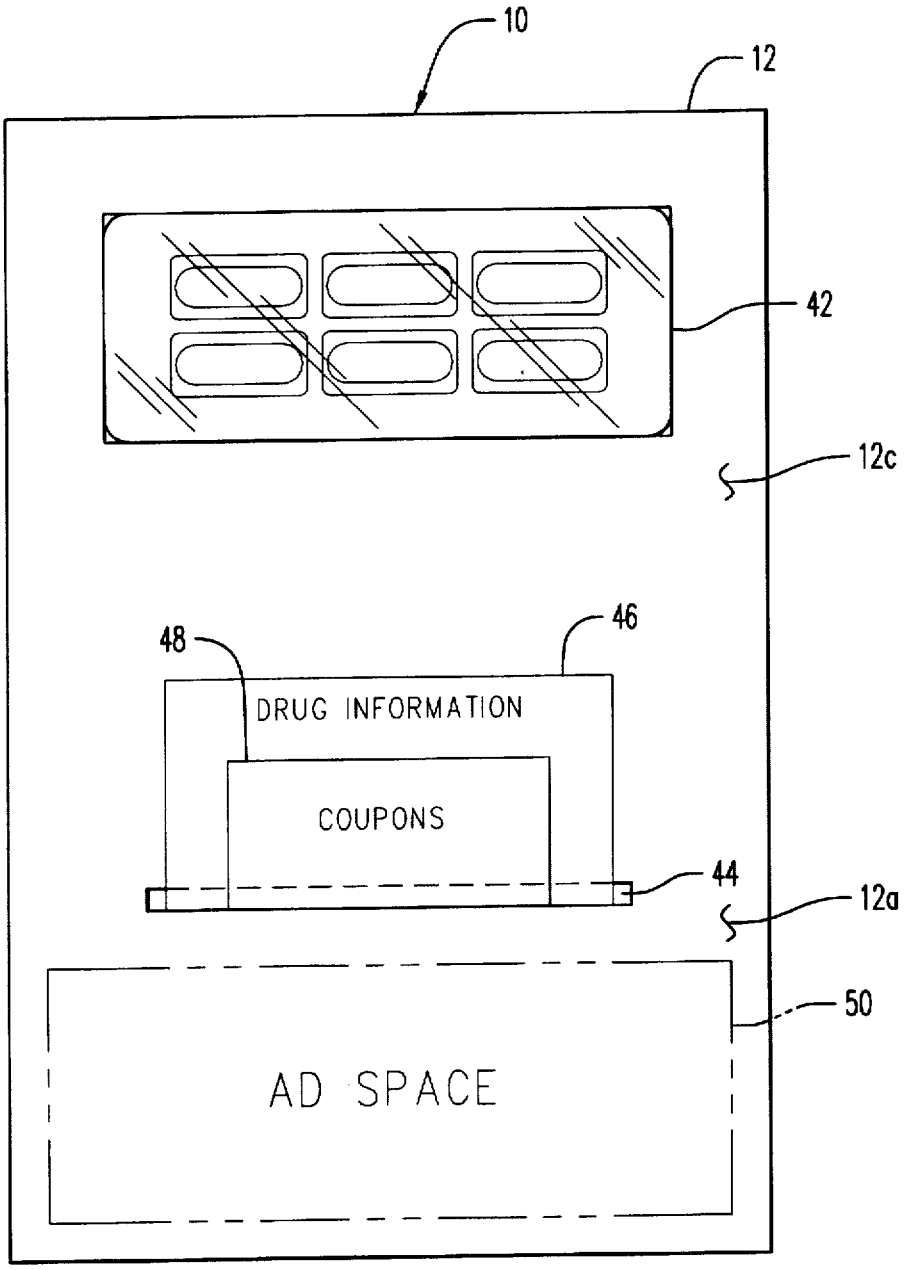
FIG. 4 is a plan view of the reverse or back surface of FIG. 3.

An additional feature of the invention is shown in FIG. 4 wherein the back layer 12*a* of support panel 12 includes a slit 44 formed therethrough to define a pocket so that discount coupons for refills 48, a drug information sheet 46 and the like may be inserted through the slit 44 into the pocket as representing important additional information to be conveniently provided for the benefit of the patient. Additional advertising space 50 for promoting the medication and the pharmaceutical manufacturer and a corresponding drawing 42 of the medication as viewed through the transparent medication container from the front are also provided for enhancement.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A combination medication sample and medication prescription device comprising:

a flat support panel having first and second portions of an obverse surface thereof;

a removable and reusable sample medication enclosure containing a sample quantity of medication attached to said first portion;

a separate removable medication prescription form held by releasable adhesive only to said second portion;

advertising indicia printed on a back surface of said support panel;

a flat cover panel connected to said support panel along a common margin thereof, said common margin defining a fold line, said cover panel sized for protectively covering substantially only said prescription form prior to use thereof;

a pocket defined between a back layer attached to and generally coextensive with said support panel and said second portion of said support panel for receiving removable printed material therein through a slit or cut formed through said back layer;

advertising and promotion indicia describing said medication sample printed on each surface of said cover panel.

2. A combination medication sample and medication prescription device consisting essentially of:

a flat support panel having first and second portions of an obverse surface thereof;

a removable sample medication enclosure containing a sample quantity of medication attached to said first portion;

a removable medication prescription form attached to said second portion;

a pocket accessible by a slit or cut formed through a back surface of a back layer connected against and substantially coextensive with said support panel for receiving removable printed material therein which is held between said back layer and said second portion relating to said sample medication;

advertising indicia displayed on said back surface;

a flat cover panel connected to said support panel along a common margin thereof, said common margin defining a fold line, said cover panel sized for protectively covering substantially only said prescription form prior to use thereof, advertising and promotion indicia describing said medication sample displayed on each surface of said cover panel.

3. A combination medication sample and medication prescription device consisting of:

a flat support panel having first and second portions of an obverse surface thereof;

a removable sample medication enclosure containing a sample quantity of medication attached to said first portion;

a removable medication prescription form attached to said second portion;

a pocket defined between a back layer attached to and generally coextensive with said support panel and said second portion of said support panel for receiving removable printed material therein through a slit or cut formed through said back layer relating to said sample medication;

advertising indicia printed on said back surface;

a flat cover panel connected to said support panel along a common margin thereof, said common margin defining a fold line, said cover panel sized for protectively covering substantially only said prescription form prior to use thereof;

advertising and promotion indicia describing said medication sample printed on each surface of said cover panel;

said medication enclosure being reusable.

* * * * *